US006908011B2

(12) United States Patent
Cho

(10) Patent No.: US 6,908,011 B2
(45) Date of Patent: Jun. 21, 2005

(54) CAP DEVICE FOR MIXING DIFFERENT KINDS OF MATERIALS SEPARATELY CONTAINED THEREIN AND IN BOTTLE

(76) Inventor: Young Kook Cho, 3090 E. 50th St., Vernon, CA (US) 90052

( * ) Notice: Subject to any disclaimer, the term of this patent is extended or adjusted under 35 U.S.C. 154(b) by 51 days.

(21) Appl. No.: 10/693,578

(22) Filed: Oct. 27, 2003

(65) Prior Publication Data

US 2004/0200856 A1 Oct. 14, 2004

(30) Foreign Application Priority Data

Apr. 12, 2003 (KR) ..... 10-2003-0023240

(51) Int. Cl.[7] ..... B67D 5/00

(52) U.S. Cl. ..... 222/83; 222/129; 222/145.1; 222/481.5

(58) Field of Search ..... 222/80, 81, 83, 222/129, 145.1, 481.5, 548

(56) References Cited

U.S. PATENT DOCUMENTS 3,347,410 A * 10/1967 Schwartzman ..... 222/80
3,404,811 A * 10/1968 Cernei ..... 222/83
3,968,872 A * 7/1976 Cavazza ..... 206/222
5,071,034 A * 12/1991 Corbiere ..... 222/80
5,165,581 A * 11/1992 Uhl ..... 222/480
5,984,141 A * 11/1999 Gibler ..... 222/80
6,073,803 A * 6/2000 Sturm et al. ..... 222/80

* cited by examiner

*Primary Examiner*—Joseph A. Kaufman
(74) *Attorney, Agent, or Firm*—Jerry H. Noh

(57) ABSTRACT

A cap device for bottles, which smoothly and naturally removes a vacuum pressure from a cavity containing an additive therein by opening a valve cock in response to a rotating action of a cap body. The cap device having a cap body provided with a cavity to contain an additive therein and tightened to an externally threaded mouth of a bottle. A funnel part being integrally formed in the cap body to discharge the additive from the cavity into the bottle through a lower end thereof. A small vent hole being formed at a top surface of the cap body. A breakable sheet being attached to the lower end of the funnel part to close the lower end of the funnel part. A valve cock being provided at the vent hole of the cap body to open or close the vent hole. A projection being provided at a predetermined position on a top edge of the mouth of the bottle to thrust and open the valve cock with downward rotation of the cap body. The cap device also has a valve having a structure capable of allowing a liquid to pass therethrough. The valve being placed in a neck of the bottle, such that the valve thrusts and breaks the breakable sheet when the cap body is rotated to move downward relative to the mouth of the bottle.

6 Claims, 4 Drawing Sheets

CAP DEVICE FOR MIXING DIFFERENT KINDS OF MATERIALS SEPARATELY CONTAINED THEREIN AND IN BOTTLE

BACKGROUND OF THE INVENTION

1. Field of the Invention

The present invention relates, in general, to caps for bottles which contain a variety of materials, such as drinks, liquid medicines or liquid chemicals, therein and, more particularly, to a cap device for such bottles, which is capable of mixing an additive contained therein with a material contained in a bottle to prepare a mixture in accordance with a simple rotating action of the cap device relative to the bottle, performed by a user, thus allowing the user to easily prepare the mixture just before taking or using the mixture.

2. Description of the Related Art

In the prior art, most of conventional disposable bottles circulated and sold in markets each contain therein only a single kind of material, such as a drink, a liquid medicine or a liquid chemical, and are closed by caps at mouths thereof. When a user wants to add an additive to the material contained in such a capped bottle so as to prepare a mixture prior to taking or using the mixture, the user must add the additive from a separate container to the bottled material after removing a cap from the bottle. Therefore, it is necessary for manufacturers of the additives and the bottled materials to separately contain such additives and materials in separate containers and bottles prior to marketing them, thus undesirably wasting natural resources due to the production of the separate containers and capped bottles. In addition, the adding of the additive from the separate container to the bottled material to mix them after removing the cap from the bottle is inconvenient to the user in that the user is forced to separately purchase and handle the additive container and the bottle. Furthermore, there is a likelihood that the additive may leak or spill during the mixing process and fall onto the user's body or garment.

Also, it is difficult for the user to add a precise amount of the additive from the separate container to the material contained in the bottle, and so the user ends up roughly measuring the amount of the additive to be added to the bottled material. Therefore, in the case of mixing of an additive with a bottled drink to produce a mixed beverage, the rough measurement of the amount of the additive may result in change in taste and quality of the mixed beverage. In the case of mixing of an additive with a bottled liquid medicine or a bottled liquid chemical to produce a mixed medicine or a mixed chemical, the rough measurement of the amount of the additive may result in incomplete dissolution of effective ingredients of the additive in the medicine or the chemical and a failure of accomplishment of desired medical or chemical effects of the mixed medicine or the mixed chemical.

Of course, when mixtures are prepared by manufacturers at factories and are marketed in a bottled state, in place of allowing users to mix additives with bottled materials to prepare mixtures just before taking or using the mixtures, it is possible to avoid the above-described problems experienced in the mixing of the additives with the bottled materials performed by the users. However, the mixtures which are prepared by the manufacturers and marketed in the bottled state are problematic in that the effects of ingredients of the bottled mixtures may be gradually degraded as time goes by, in addition to change in colors of the mixtures.

Furthermore, the bottled mixtures may generate floating matters and deposit therein with passage of time.

In an effort to overcome the above-described problems, the inventor of the present invention proposed cap devices for bottles, which are capable of mixing an additive contained therein with a material contained in a bottle to prepare a mixture. However, such proposed cap devices are problematic as follows. That is, when a cap body is rotated to move up relative to a mouth of a bottle and thereby to open a cavity of the cap body, a vacuum pressure is not smoothly removed from the cavity containing the additive therein. In an effort to overcome the problem, a small vent hole having a valve cock to open or close the vent hole is formed at a top surface of a cap cover assembled with the cap body into the cap device. However, when the valve cock is not timely or appropriately opened, the vacuum pressure is not smoothly removed from the cavity. In such a case, the additive cannot smoothly flow from the cavity into the bottle through a lower end of a funnel part provided in the cap body.

SUMMARY OF THE INVENTION

Accordingly, the present invention has been made keeping in mind the above problems occurring in the prior an, and an object of the present invention is to provide a cap device for bottles, which is capable of mixing an additive contained therein with a bottled material to prepare a mixture in accordance with a simple rotating action of the cap device relative to a bottle by a user, thereby allowing the user to easily prepare the mixture just before taking or using the mixture.

Another object of the present invention is to provide a cap device for bottles, which smoothly and naturally removes a vacuum pressure from a cavity containing the additive therein in response to a rotating action of a cap body in which the cap body is rotated to move down relative to a mouth of the bottle, thus allowing the user to easily and conveniently use the cap device, and which timely removes the vacuum pressure from the cavity, thereby allowing the additive to smoothly flow from the cavity into the bottle through a lower end of a funnel part of the cap body in response to the rotating action of the cap body.

In order to accomplish the above objects, the present invention provides a cap device for bottles, comprising: a cap body having a cavity to contain an additive in the cavity and tightened to an externally threaded mouth of a bottle, with a funnel part integrally formed in the cap body to discharge the additive from the cavity into the bottle through a lower end thereof, and a small vent hole formed at a top surface of the cap body; a breakable sheet attached to the lower end of the funnel part to close the lower end of the funnel part; a valve cock provided at the vent hole of the cap body to open or close the vent hole; a projection provided at a predetermined position on a top edge of the mouth of the bottle to thrust and open the valve cock; and a valve means placed in a neck of the bottle having a structure capable of allowing a liquid to pass through it, such that the valve means thrusts and breaks the breakable sheet when the cap body is rotated to move downward relative to the mouth of the bottle.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION OF THE INVENTION

Figure 1A:
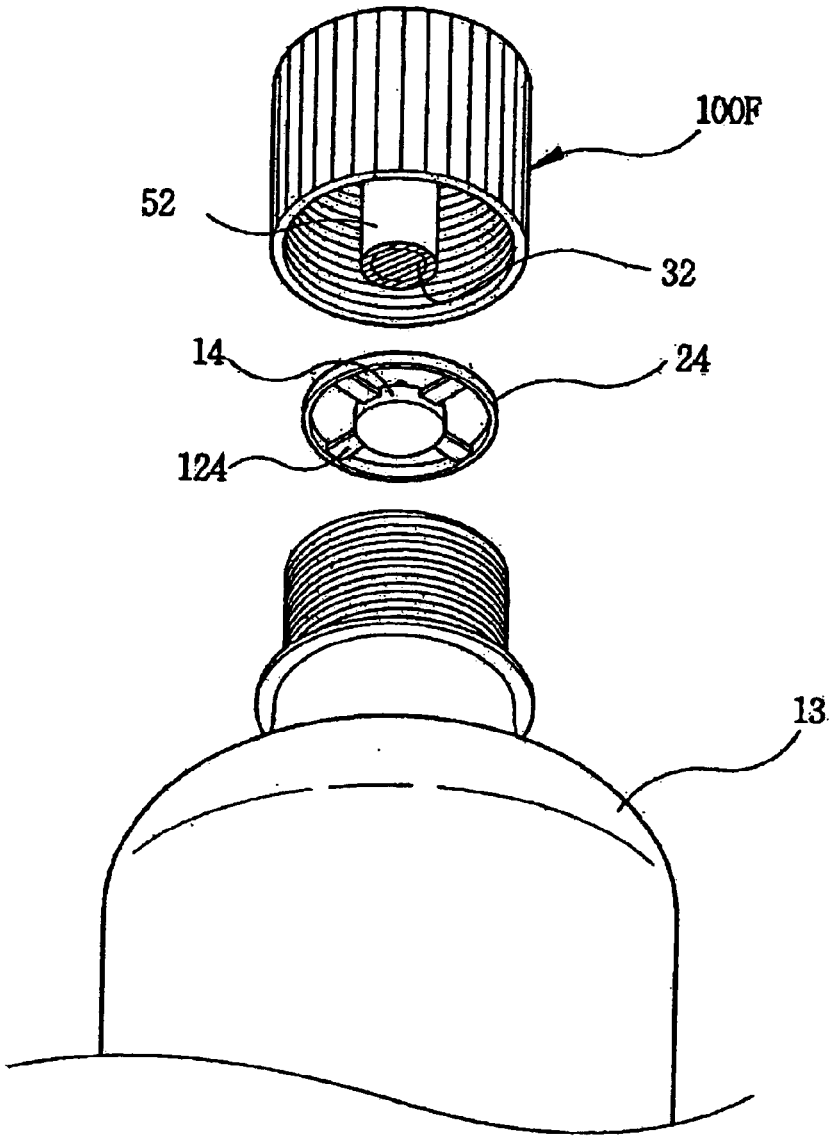
FIGS. 1*a* and 1*b* are exploded perspective views showing a construction of a cap device, according to an embodiment of the present invention.
Figure 1B:
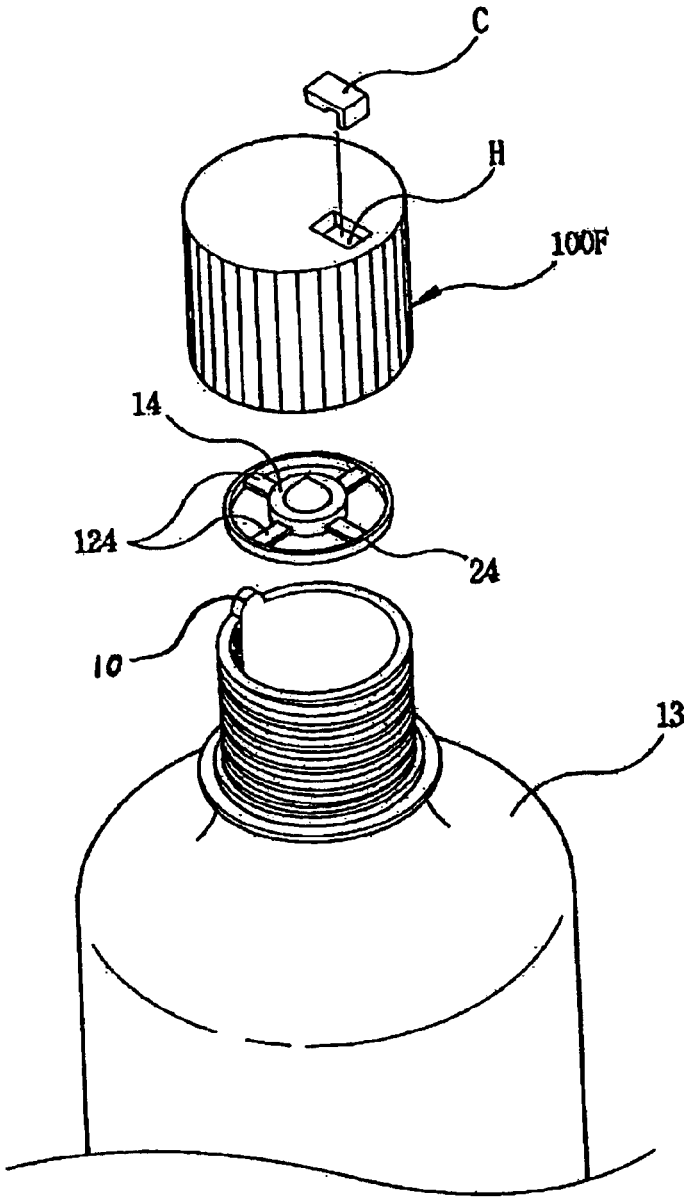
Figure 2:
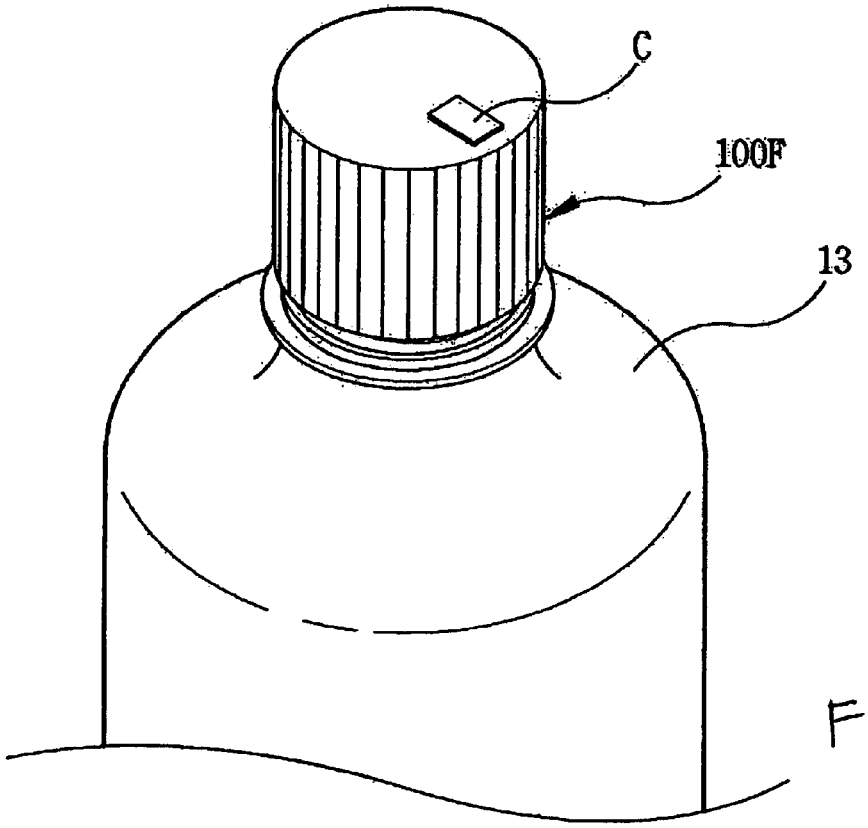
FIG. 2 is a perspective view of the cap device of FIGS. 1*a* and 1*b*, when the assembled cap device is tightened to a mouth of a bottle.

Reference should now be made to the drawings, in which the same reference numerals are used throughout the different drawings to designate the same or similar components.

FIGS. 1*a* through 3*b* are views of a cap device for bottles according to an embodiment of the present invention. As shown in the drawings, the cap device according to the present invention comprises a cap body 100F defining a cavity therein to contain an additive in the cavity. A funnel part 52 is integrally formed in the cap body 100F to discharge the additive into a bottle 13 through an opening formed at a lower end thereof A sheet of breakable material 32 is attached to the lower end of the funnel part 52 to close the opening formed at the lower end of the funnel part 52. A small vent hole "H" is formed at a top surface of the cap body 100F. A valve cock "C" is moveably placed at the vent hole "H" to open or close the vent hole "H". The bottle 13 has a projection 10 protruding upward from a predetermined position on a top edge of a mouth thereof. The cap device also has a valve means to allow the cavity of the cap body 100F to selectively communicate with an interior of the bottle 13.

In a detailed description, the cap body 100F is tightened to the externally threaded mouth of the bottle 13, with the funnel part 52 integrally formed in the cap body 100F to discharge the additive into the bottle 13 through the lower end thereof.

The funnel part 52 is shaped to define the cavity in cooperation with the cap body 100F and to smoothly guide the additive downward. The sheet 32 is attached to the lower end of the funnel part 52 to close the lower end of the funnel part 52.

Figure 3A:
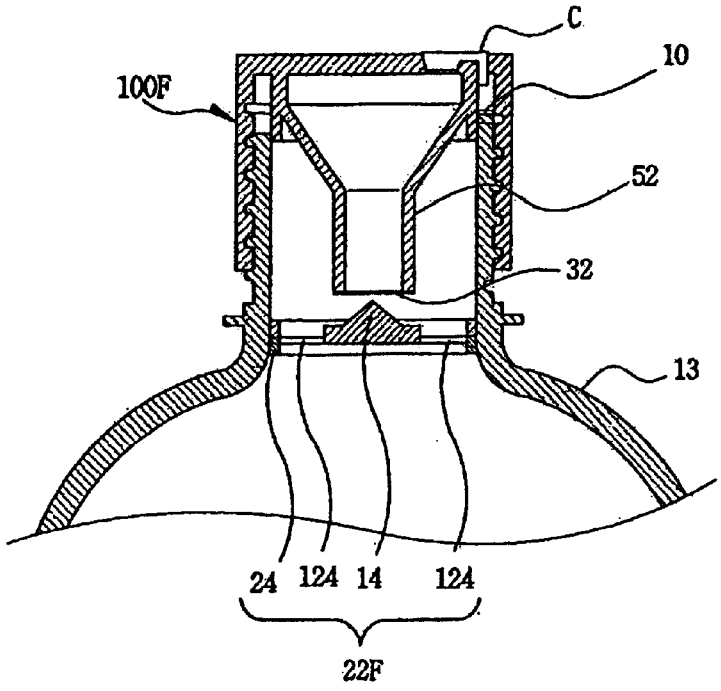
FIGS. 3*a* and 3*b* are sectional views showing an operation of the cap device of FIG. 2.
Figure 3B:
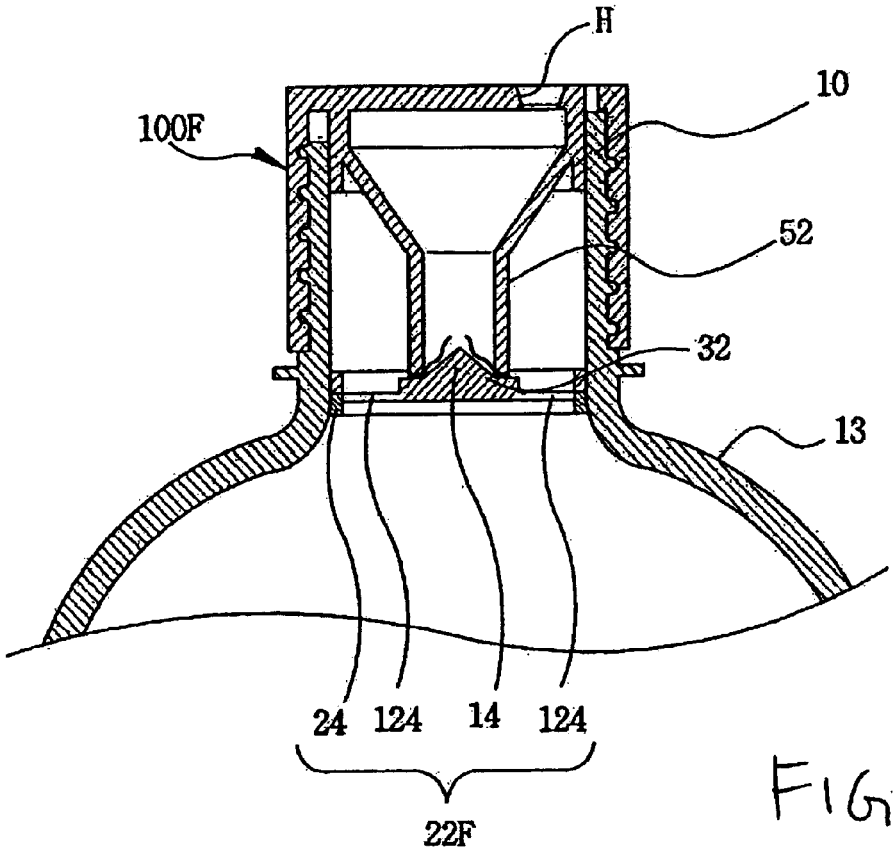

The valve cock "C" is formed and placed so that from a position closing the vent hole "H" as shown in FIG. 3*a*, it can be thrusted upward by the projection 10 formed at the top edge of the bottle mouth to open the vent hole "H" when the cap device is rotated in a first predetermined direction moving the cap device downward relative to the bottle as shown in FIG. 3*b*.

The valve means, having a structure capable of allowing a liquid to pass therethrough, is stably placed in a neck of the bottle 13. The valve means has a conical valve part to thrust the sheet of breakable material 32 upward to break the sheet 32 when the cap body 100F is moved downward relative to the mouth of the bottle 13.

That is, the valve means comprises a valve member 22F having a conical valve part 14 which thrusts the sheet 32 upward to break the sheet 32 when the cap body 100F is twisted in the first predetermined direction to move the cap body 100F downward relative to the mouth of the bottle 13. A plurality of radial ribs 124 extend outward from an external surface of the conical valve part 14 in radial directions. A ring 24 is integrated with outside ends of the radial ribs 124 so as to be stably placed in the neck of the bottle at a predetermined position.

When the cap body 100F of the cap device having the above-described construction is rotated in the first predetermined direction, the conical valve part 14 of the valve member 22F thrusts the sheet 32 upward to break the sheet 32, as shown in FIG. 3*b*. In such a case, the valve cock "C" is thrust upward by the projection 10 of the bottle mouth, thus opening the vent hole "H" formed at the top surface of the cap body 100F, as shown in FIG. 3*b*.

Thereafter, the cap body 100F is rotated in a second predetermined direction to move the cap body upward relative to the bottle mouth, so that the lower end of the funnel part 52 having the broken sheet 32 is spaced apart from the valve member 22F, as shown in FIG. 3*a* The cavity of the cap device thus communicates with the interior of the bottle 13. The additive is discharged from the cavity of the cap body 100F through the open lower end of the funnel part 52, and passes through the spaces between the radial ribs 124 of the valve member 22F, thus being added to the material contained in the bottle 13.

Since the vent hole "H" is opened by the valve cock "C" as described above, the vacuum pressure is smoothly and naturally removed from the cavity of the cap body 100F containing the additive therein, without requiring any additional action. Therefore, the additive smoothly flows from the cavity into the bottle 13 through the open lower end of the funnel part 52 of the cap body 100F.

As described above, the present invention provides a cap device for bottles, which is capable of mixing an additive contained therein with a bottled material to prepare a mixture in accordance with a simple rotating action of the cap device relative to a bottle by a user, thereby allowing the user to easily prepare the mixture just before taking or using the mixture. The cap device of the present invention allows the additive and the bottled material to be maintained in pure states without being mixed together before a user adds the additive to the bottled material by rotating the cap device relative to a mouth of the bottle. The cap device is thus free from physical or chemical problems of degradation in the effects of ingredients, change in colors, and a generation of floating matters and deposit experienced in conventional bottled mixtures marketed in a bottled state.

In addition, the cap device of the present invention allows the additive and the bottled material to be stored in separate states, and allows the user to mix a precise amount of the additive with the bottled material to prepare the mixture. Thus, the cap device does not force the user to separately purchase and handle an additive container and the bottle, and is convenient to the user. The cap device is also free from excessive consumption of natural resources due to the separate production of the containers for additives and the capped bottles. Since the cap device allows the user to mix the precise amount of the additive with the bottled material to prepare the mixture, it is possible to prevent change in taste and quality of the mixture in the case of preparing a mixed beverage through the mixing, and to prevent incomplete dissolution of effective ingredients of the additive in the bottled material or a failure of accomplishment of desired medical or chemical effects of the mixture in the case of preparing a mixed medicine or a mixed chemical through the mixing.

Furthermore, the cap device of the present invention smoothly and naturally removes a vacuum pressure from a cavity containing the additive therein in response to a rotating action of a cap body in which the cap body is rotated to move down relative to a mouth of the bottle, thus allowing the user to easily and conveniently use the cap device. The cap device also timely removes the vacuum pressure from the cavity, thereby allowing the additive to smoothly flow from the cavity into the bottle through an open lower end of a funnel part of the cap body in response to the rotating action of the cap body.

Although a preferred embodiment of the present invention has been described for illustrative purposes, those skilled in the art will appreciate that various modifications, additions and substitutions are possible, without departing from the scope and spirit of the invention as disclosed in the accompanying claims.

What is claimed is:

1. A cap device for a bottle, said cap device comprising:

a cap body defining a cavity therein to contain an additive, said cap body being removeably tightened to an externally threaded mouth of said bottle, a funnel part integrally formed in the cap body to discharge the additive from the cavity into the bottle through a lower end thereof, an opening formed at said lower end of said funnel part;

a vent hole formed at a top surface of the cap body;

a sheet of breakable material attached to the lower end of the funnel part to close the opening formed at said lower end of the funnel part;

a valve cock provided at the vent hole of the cap body to open or close the vent hole;

a projection provided at a predetermined position on the mouth of the bottle; said projection formed to engage and move said valve cock from a position closing said vent hole to open said vent hole when said cap body is rotated in a first predetermined direction to move said cap body downward relative to the mouth of the bottle; and, a valve means placed in a neck of said bottle, said valve means having a structure capable of allowing a liquid to pass through said valve means, said valve means formed to press against and break the sheet of breakable material when the cap body is rotated in the first predetermined direction.

2. The cap device for bottles according to claim 1, wherein the valve means comprises:

a conical valve part formed to thrust the breakable sheet upward to break the sheet of breakable material when the cap body is rotated in the first predetermined direction;

a plurality of radial ribs extending outward from an external surface of the conical valve part in radial directions; and, a ring integrated with outside ends of the radial ribs so as to be placed in the neck of the bottle.

3. The cap device for a bottle as described in claim 2 wherein the projection of said mouth of said bottle protrudes upward from the top surface of the mouth.

4. In a bottle having a neck and an externally threaded mouth, the improvement comprising:

a cap body defining a cavity therein to contain an additive, said cap body being removeably tightened to said externally threaded mouth of said bottle, a funnel part integrally formed in the cap body to discharge the additive from the cavity into the bottle through a lower end thereof, an opening formed at said lower end of said funnel part;

a vent hole formed at a top surface of the cap body;

a sheet of breakable material attached to the lower end of the funnel part to close the opening formed at said lower end of the funnel part;

a valve cock provided at the vent hole of the cap body to open or close the vent hole;

a projection provided at a predetermined position on the mouth of the bottle; said projection formed to engage said valve cock and move said valve cock from a position closing said vent hole to open said vent hole when said cap body is rotated in a first predetermined direction to move said cap body downward relative to the mouth of the bottle; and, a valve means placed in said neck of said bottle, said valve means having a structure capable of allowing a liquid to pass through said valve means, said valve means formed to press against and break the sheet of breakable material when the cap body is rotated in the first predetermined direction.

5. The bottle according to claim 4, wherein the valve means comprises:

a conical valve part formed to thrust the breakable sheet upward to break the sheet of breakable material when the cap body is rotated in the first predetermined direction;

a plurality of radial ribs extending outward from an external surface of the conical valve part in radial directions; and, a ring integrated with outside ends of the radial ribs so as to be placed in the neck of the bottle.

6. The bottle as described in claim 5 wherein the projection of said mouth of said bottle protrudes upward from the top surface of the mouth.

* * * * *